United States Patent [19]

Ganz

[11] Patent Number: 4,651,502

[45] Date of Patent: Mar. 24, 1987

[54] VARIABLE PLANE COMPRESSION APPARATUS, METHOD OF UTILIZING SAME, AND CARTON FOR USE THEREWITH

[75] Inventor: Robert H. Ganz, Saddle River, N.J.

[73] Assignee: Federal Paper Board Co., Inc., Montvale, N.J.

[21] Appl. No.: 716,492

[22] Filed: Mar. 27, 1985

[51] Int. Cl.[4] ..... B65B 21/24; B65B 27/04; B65B 13/24

[52] U.S. Cl. ..... 53/398; 53/48; 53/590

[58] Field of Search ..... 53/48, 398, 209, 556, 53/590

[56] References Cited

U.S. PATENT DOCUMENTS

| | | | |
|---|---|---|---|
| 3,197,937 | 8/1965 | Ganz | 53/48 |
| 3,474,590 | 10/1969 | Ganz | 53/590 X |
| 3,557,521 | 1/1971 | Pierce, Jr. | 53/590 X |
| 3,572,003 | 3/1971 | Perry et al. | 53/48 X |
| 3,981,120 | 9/1976 | Ganz | 53/48 |
| 4,285,185 | 8/1981 | Collura et al. | 53/48 |
| 4,338,760 | 7/1982 | Kuhn | 53/590 X |
| 4,481,750 | 11/1984 | Cooley | 53/48 X |

*Primary Examiner*—Horace M. Culver

*Attorney, Agent, or Firm*—Charles E. Brown; Charles A. Brown

[57] ABSTRACT

This relates to providing internal compression in packages of the type utilizing a wrap around carton. Instead of utilizing locking cut outs provided for receiving articles to be packaged, special compression cuts are formed in the closure panels of a wrap around carton so that the compression cuts are independent of the locking cut outs thereby permitting one chain and lug arrangement to be utilized in conjunction with numerous types of packages. The lugs are carried by compression chains located in a plane below the support plane of the articles to be packaged with the lugs being pivotally mounted on pins and normally having downwardly sloping positions for engaging in the compression cuts when the closure flaps are in their generally vertical depending position. The lugs are swingable upwardly to generally horizontal positions with the closure panels. Each lug carries a finger having a nose particularly configurated for automatically entering and centering within a compression cut.

20 Claims, 9 Drawing Figures

FLOW

VARIABLE PLANE COMPRESSION APPARATUS, METHOD OF UTILIZING SAME, AND CARTON FOR USE THEREWITH

This invention relates in general to new and useful improvements in the formation of packages wherein cartons of the wrap around type have side panels pulled tightly around the articles being packaged with the tightened side panels being held in that state while the closure panels of the carton are folded into position and secured relative to one another. Most particularly, this invention relates to an apparatus which is an improvement on the apparatus disclosed and claimed in my prior U.S. Pat. No. 3,474,590 and an improved carton of the type disclosed in my prior U.S. Pat. No. 3,556,386.

The major advantage of the compression system of this invention is that it greatly simplifies and shortens the changeover time when going from one pack size or grouping to another. Presently, the internal compression system provides a tightening lug for each container in a package. The tightening lugs are carried by chains which must be replaced or the individual lugs moved with respect to the chains when changing the apparatus from one conatiner grouping or one container diameter to a different one. This operation is the most time-consuming part of an entire changeover.

In accordance with this invention, the tightening lugs are disassociated from the individual containers which, first of all, permits the use of fewer lugs. By placing the individual cut outs on the closure panels in positions remotely located from the individual containers, a common compression cut out location may be used in conjunction with cartons or wraps covering a range of different sizes and groupings. As a result, when utilizing the present apparatus, no compression changeover is required other than moving the compression chains closer or farther apart to accommodate different container sizes. This operation can be easily calibrated and automated for greatly simplified changeover procedure accomplished in less than half the present time.

With the above and other objects in view that will hereinafter appear, the nature of the invention will be more clearly understood by reference to the following detailed description, the appended claims, and the several views illustrated in the accompanying drawings.

Figure 3:
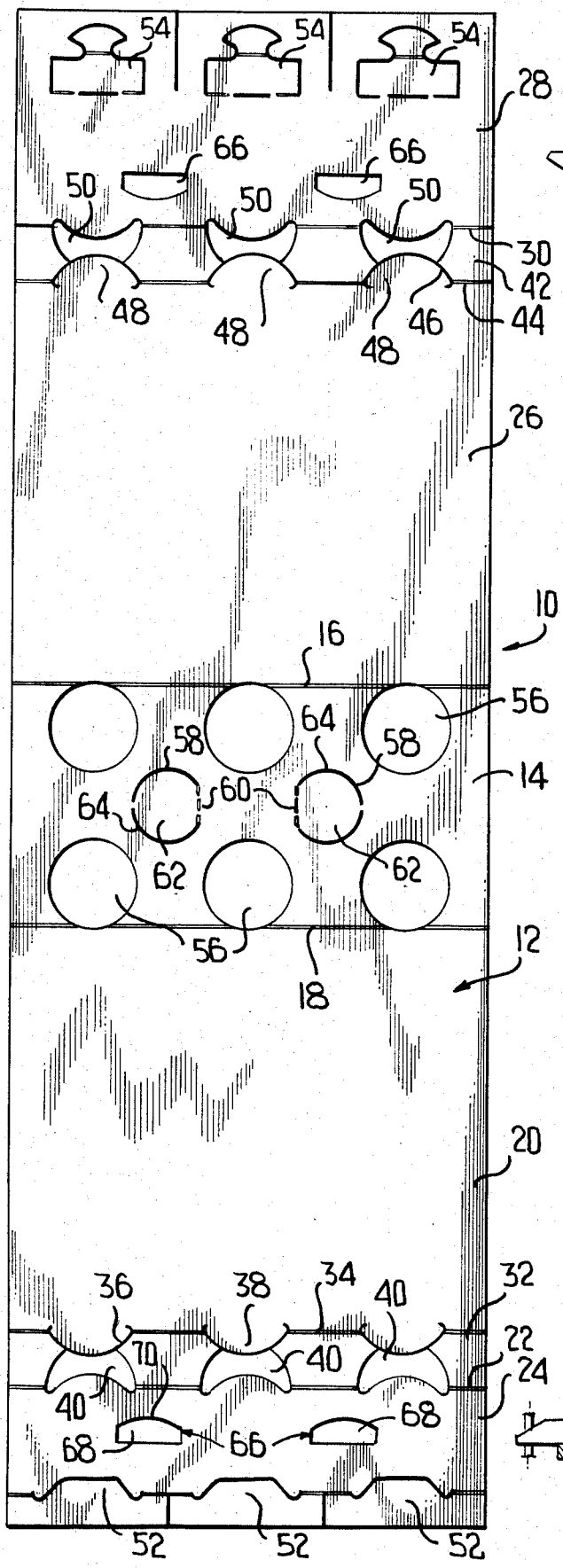
FIG. 3 is a plan view of a blank for forming a carton in accordance with this invention.

Referring now to the drawings in detail, reference is first made to FIG. 3 wherein there is illustrated a carton blank for a carton formed in accordance with this invention, the carton blank being generally identified by the numeral 10. The carton blank 10 is in the form of an elongated, generally rectangular, strip of paperboard with the strip being generally identified by the numeral 12. The strip 12 has a central portion in the form of a top panel 14 which is set out from the remainder of the strip 12 by a pair of transverse fold lines 16, 18. A first side panel 20 is joined to the top panel 14 along the fold line 18 and, in turn, has connected thereto along a transverse fold line 22 an inner closure panel 24.

A second side panel 26 is connected to the top panel 14 along the fold line 16 and in turn carries an outer closure panel 28 which is connected thereto along a transverse fold line 30.

The side panel 20 has a lower panel portion 32 which extends between the fold line 22 and a fold line 34 with the fold line 34 being interrupted by part circular cuts 36 defining flaps 38. The flaps 38 are centered on the containers which are to be packaged within the carton formed by the blank 10. In alignment with each of the flaps 38 is a locking cut out 40 which extends partially across the fold line 22 into the closure panel 24. The base of each of the containers or like article which is to be packaged within the resultant carton projects through and is locked within the cut out 40.

The side panel 26 has a like lower portion 42 which extends between the fold line 30 and a transverse fold line 44 which is interrupted by a second set of arcuate cut lines 46 defining flaps 48. A further locking cut out 50 is aligned with each of the flaps 48 for receiving the base of a container. The cut outs 50 extend across the fold line 30 into the closure panel 28.

The closure panel 24 is considered to be the primary locking panel and carries primary locks 52. On the other hand, the closure panel 28 may be considered to be a male locking panel and carries male locks 54.

The top panel 14 may be provided with suitable openings 56 for receiving necks of bottles. Further, there are provided combinations of cut lines 58 and fold lines 60 defining tabs 62 which, when pushed into the interior of the resultant carton, define finger receiving openings 64.

The carton blank 10, as described, is in accordance with my U.S. Pat. No. 3,556,386 and as such is known. The carton blank 10 and the carton formed therefrom is improved in accordance with this invention by the provision in the panels 24 and 28 of compression cut outs 66. Each compression cut out 66 includes a generally rectangular base portion 68 which is generally parallel to the respective one of the fold lines 22, 30 and is remote therefrom. Each compression cut out 66 also includes a portion defined by an arcuate cut line 70 so as to have a domed appearance. The arcuate cut line 70 generally faces the respective one of the fold lines 22, 30.

It is to be understood that the compression cut outs 66 may be positioned as desired in the width direction of the panels 24, 28 with the positions of the compression cut outs 66 being in no way dependent upon the positions of the locking cut outs 50 and the intended position of articles or containers within the resultant carton.

Having described the carton improvement in accordance with this invention, reference is now made to FIGS. 1, 2 and 4–7 which show generally the details of a package forming apparatus having associated therewith the compression apparatus which is a feature of the invention. In a known manner, when packaging bottles, for example, arranged in columns and rows, such bottles or like containers are arranged in groups which in the illustrated embodiment of the invention contains six containers. The carton blank 10 will be placed into overlying relation to each group of containers and in the case of containers having necks and closures, the necks and closures will pass through the openings 56. Thereafter, the side panels 20, 26 will be plowed down to extend down along side the group of containers in the manner generally shown at the right in FIG. 2. At this time the closure panels 24, 28 will depend down as continuations of the side panels 20, 26.

Figure 4:
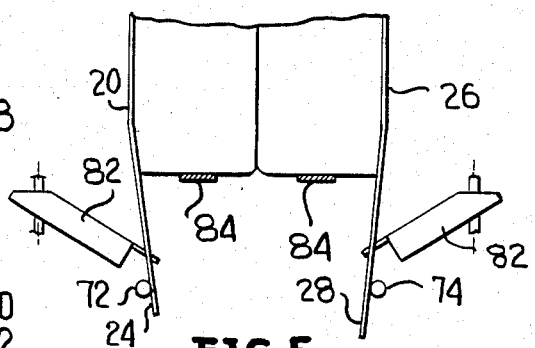
FIG. 4 is a schematic transverse vertical sectional view taken generally along the line 4—4 of FIG. 1 and shows the fingers of the compression lugs initially engaging in compression cut outs in closure panels of a carton.
Figure 5:
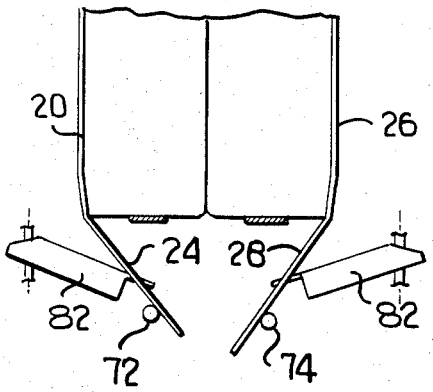
FIG. 5 is a fragmentary vertical sectional view taken generally along the line 5—5 of FIG. 1 and shows the compression lugs as they move together with the fingers thereof engaged in the closure panels as they fold upwardly beneath the containers.

In the absence of the tightening of the carton with respect to the containers, in a conventional manner utilizing suitable plowers or the like identified by the reference numerals 72, 74 in FIGS. 4 and 5, the closure panels 24 and 28 will be folded up beneath the group of containers with the closure panel 24 being advanced ahead of the closure panel 26. As the closure panels 24, 26 approach their horizontal positions of FIG. 6, the primary locks 52 and the male locks 54 will be sequentially engaged so as to lock together the closure panels 24, 26. The details of this are not illustrated in that it in of itself does not form part of this invention.

Figures 1, 2, 8, 9:
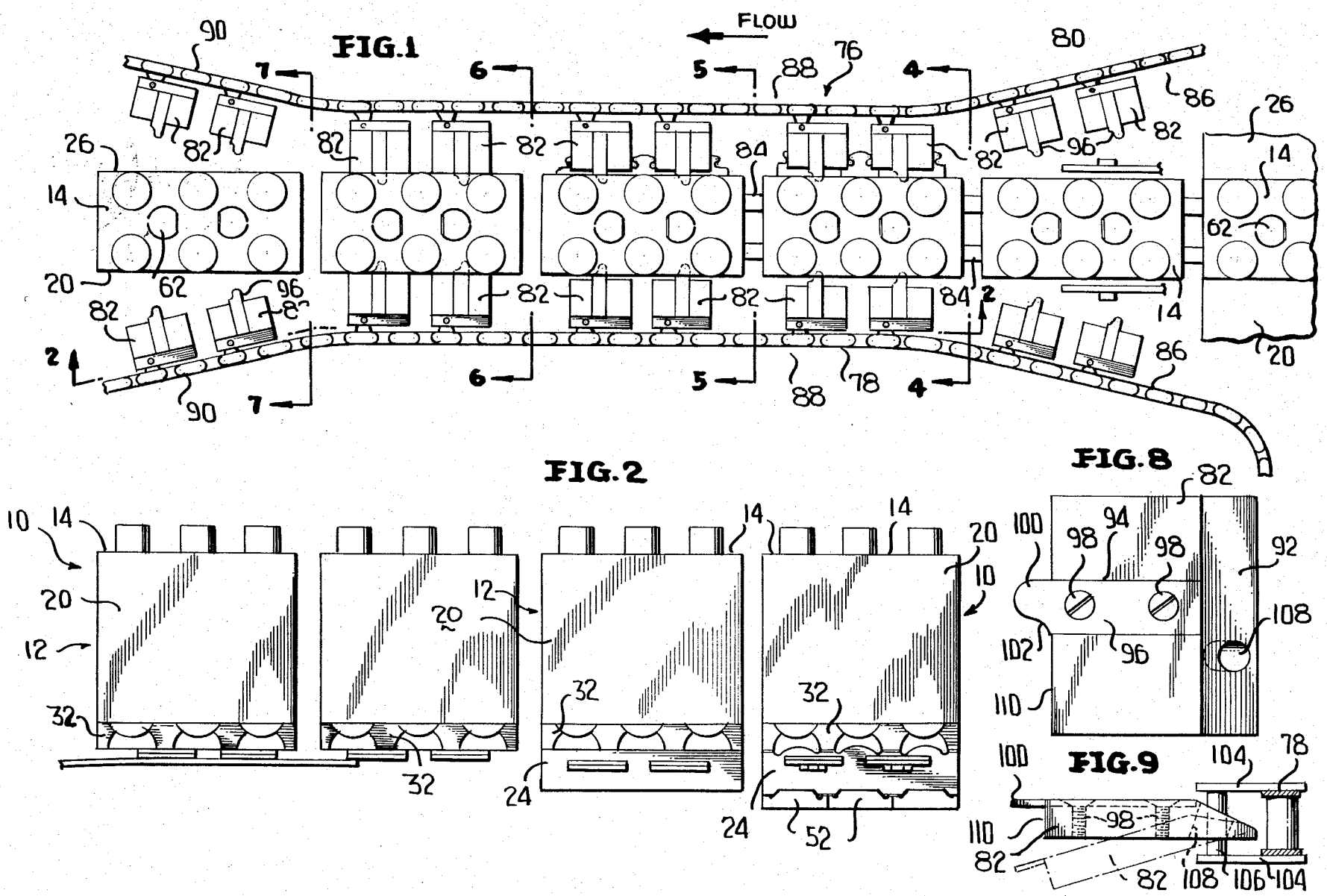
FIG. 1 is a plan view of an apparatus for applying cartons to a plurality of articles, such as containers, to form packages and incorporates the compression apparatus of this invention.
FIG. 2 is a fragmentary vertical sectional view taken generally along the line 2—2 of FIG. 1 and shows further the details of the compression apparatus in relation to the cartons.
FIG. 8 is an enlarged plan view of a typical compression lug and the finger carried thereby.
FIG. 9 is an enlarged sectional view taken through one of the conveyor chains for the lugs and shows the mounting of a typical lug on a barrel pin carried by the associated carrier chain.
Figure 6:
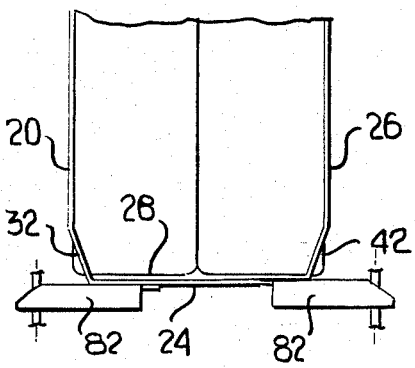
FIG. 6 is a fragmentary sectional view taken generally along the line 6—6 of FIG. 1 and shows the closure panels in their fully closed positions and lower portions of the side panels drawn tightly together about the containers.

In accordance with this invention it is desired that the lower portions of the side panels 20, 22 be drawn tight around the containers with the panel portions 32, 42 being tightly drawn around the base portions of the containers in the manner shown in FIG. 6 so as to interlock the containers with the side panels 20, 26. To this end there is provided the compression cut outs 66 and a variable plane compression apparatus generally identified by the numeral 76. The apparatus 76 includes a pair of chains 78, 80 which carry at regularly spaced intervals sets of lugs 82 as is best shown in FIG. 1. The chains 78, 80 lie in a common plane below the plane of supports for the containers, which supports are illustrated as flat strips 84 in FIGS. 4 and 5. The chains 78, 80 are continuous and pass about a predetermined path. The path of the chains 78, 80 include a first converging portion 86 wherein the chains 78, 80 rapidly move together. This is followed by a second converging portion 88 wherein the chains 78, 80 slope only slightly with respect to the path of movement of the group of containers. It is along this portion of the path that the closure panels 24, 28 are drawn together so as to draw the panel portions 32, 42 tightly about the containers which are being packaged.

The path of the chains 78, 80 include diverging portions 90 where the chains move away from the formed containers.

Reference is now made to FIGS. 8 and 9 wherein there is illustrated a typical lug 82. Each lug 82 is of a rectangular outline and is formed of a thick plate. One edge of the lug 82 is bevelled as at 92 while the remainder of the lug is of a uniform thickness except for having a groove 94 in which there is seated a major portion of a finger 96. The finger 96 is secured to the lug 82 by a pair of screws 98 having countersunk heads.

It will be seen that each finger 96 projects beyond the lug 82 and has a rounded nose 100 which is offset to one side of the center of the finger 96 so as to facilitate entry of the finger 96 into a respective compression cut out 66. At the opposite edge of the finger 96, the projecting part of the finger is provided with an arcuate guide portion 102 which serves to center the projecting nose of the finger in the respective compression cutout 66.

Each of the carrier chains 78, 80 carries at intervals support bars 104 which have extending therebetween a barrel pin 106 which is vertically disposed. The barrel pin 106 extends through a larger diameter bore 108 in the bevelled portion 92 of the lug 82 as is clearly shown in FIGS. 8 and 9. The bore 108 is at an angle to the horizontal as is clearly shown in FIGS. 8 and 9. This permits the lug 82 to assume an operative horizontal position, as shown in solid lines in FIG. 9, while permitting the lug 82 to drop or pivot to a downwardly sloping tilted position as shown in phantom lines in FIG. 9. It is to be understood that the downward tilting of the lug 82 is restricted by the walls of the bore 108 engaging the pin 106.

It is also pointed out at this time that the fingers 96 of the lugs of each set of lugs are spaced in accordance with the spacing of the compression cut outs 66 in a respective closure panel of the carton to be applied. As will be described hereinafter, the compression cut outs will be uniformly spaced in all cartons which are to be applied to a group of articles to form packages in accordance with this invention.

Referring now to FIG. 4, it will be seen that as the lugs 82 converging, the noses 100 of the fingers 96 will be at elevations to be received in the compression cut outs 66. Then as the lugs 82 pass along the path of the apparatus together with the articles being packaged and the cartons, the lugs will move further together in a gradual manner while the closure panels 24, 26 are folded up beneath the articles being packaged. The fingers 96 having been engaged within the compression cut outs 66, will effect an upward pivoting of the lugs 82 until the lugs assume horizontal positions as is best shown in FIG. 6. At this time the lugs 82 have drawn the closure panels 24 into a maximum overlapped relation with the result that the panel portions 32, 42 of the side panels 20, 26 are drawn around the base portions of the articles being packaged and interlocked therewith in the manner shown in FIG. 6.

It is to be understood that by having the fingers 96 recessed in the upper surfaces of the lugs 82, an edge 110 of each lug 82 remote from the bevelled portion 92 thereof may function as a stop surface limiting the projection of each finger 96 into the respective compression cut out 66 with the surface 110 then effectively forming the means for drawing the closure panels 24 and 26 together and effecting compression of the articles being packaged within the side panels 20, 26 in the manner shown in FIG. 6.

Figure 7:
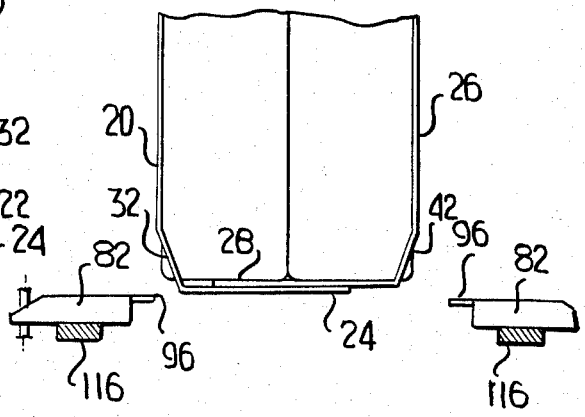
FIG. 7 is a fragmentary sectional view taken generally along the line 7—7 of FIG. 1 and shows the completely closed carton and the manner in which the compression lugs are supported as they are laterally withdrawn relative to the package.

After the package has been formed, it is necessary to withdraw the lugs 82 and the fingers 96. In order to assure movement of the lugs 82 in a horizontal plane, support bars 116 are provided. These support bars, as is shown in FIG. 7, underlie the lugs 82. After these lugs 82 reach the position shown in FIG. 7, the support bars 116 are discontinued and the lugs 82 are free to pivot relative to the pins 106 and drop to their tilted dotted line position of FIG. 9 for passage around the path of the chains 78, 80 for engagement at a later time with another carton blank in the same manner as described hereinabove.

Inasmuch as the compression lugs engage in the separately formed compression cut outs 66, it will be apparent that by utilizing a common compression cut out location cartons or wraps covering a ranch of different sizes of articles or containers as well as a different range of groupings, may be operated on by merely moving the compression chains closer or farther apart to accommodate diameter differences. Even this operation can be easily calibrated and automated for greatly simplified changeover procedure which can be accomplished in less than half the time of the prior arrangement.

Although only a preferred embodiment of the compression system and the carton blank arrangement has been specifically illustrated and described herein, it should be understood that minor variations may be made therein without departing from the spirit and scope of the invention as defined by the appended claims.

I claim:

1. A variable plane compression apparatus for automatically drawing side panels of cartons of the wrap around type tightly together in the formation of a package, said apparatus comprising a pair of generally opposed carriers, tightening lugs carried by said carriers in opposed relation, and mounting means mounting said lugs on said carriers for generally horizontal swinging movement and for tilting movement between downwardly sloping positions and generally horizontal positions whereby said lugs may engage carton closure panels.

2. An apparatus according to claim 1 together with a package forming mechanism having support means for supporting containers to be packaged for movement along a predetermined path, said support means defining a support plane, and said lugs in all positions of said lugs being below said support plane.

3. An apparatus according to claim 2 wherein said package forming mechanism has means for receiving carton closure panels initially in depending generally vertical positions, and said carriers being mounted for movement to engage substantially vertically depending carton closure panels when said lugs are in said downwardly tilted positions.

4. An apparatus according to claim 3 wherein each lug carries a projecting finger forming means for engagement in a compression cut in a carton closure panel with each lug forming stop means for limting movement of each finger into such cut.

5. An apparatus according to claim 4 wherein said package forming mechanism has means for folding carton closure panels to overlapped positions underlying and supporting containers being packaged in a carton, and said fingers have positions for interlocking in carton closure panel compression cuts for said tilting movement with carton closure panels being folded to said overlapped positions.

6. An apparatus according to claim 2 wherein each of said lugs underlies said support means.

7. An apparatus according to claim 2 wherein said lugs have longitudinal positions relative to a package being formed independently of the position of containers in that package.

8. An apparatus according to claim 1 wherein said carriers are in the form of chains each carrying at intervals upstanding pins, and each of said lugs having a bore receiving a respective one of said pins, the relative sizes of said bores and said pins facilitating tilting of said lugs relative to said chains in a vertical plane.

9. An apparatus according to claim 8 wherein each of said lugs is a plate-like member lying in a general plane, said bore being at an angle to said general plane other than 90° whereby downward tilting of said lugs is limited by engagement of walls of said bores with said pins.

10. An apparatus according to claim 9 wherein said lugs are of a thickness less than the vertical dimensions of said pins whereby said lugs have limited vertical movement on said pins.

11. An apparatus according to claim 1 wherein each lug carries a projecting finger forming means for engagement in a compression cut in a carton closure panel with each lug forming stop means for limiting movement of each finger into such cut.

12. An apparatus according to claim 11 wherein said finger has a rounded reduced width nose portion offset to one side of a center of said finger for facilitating entry of said finger in a compression cut, and said finger having at the opposite side thereof a curved guide surface for effecting centering of said finger in a compression cut out, and said lug has an edge surface for abutting a closure panel to limit entry of said finger into a compression cut.

13. An apparatus according to claim 1 together with support means for retaining said lugs in said generally horizontal positions as said lugs are being transversely withdrawn from an associated carton.

14. A method of tightening a package formed of a plurality of containers and encased in a carton of the wrap around type and wherein the carton includes side panels each carrying a closure panel; said method comprising the steps of providing a carton having formed in the closure panels thereof compression cuts, providing a package forming mechanism having means for supporting containers for movement along a preselected path and means for folding carton closure panels into cooperating overlapped relation, providing moving carriers on opposite sides of the paths of the carton closure panels with the carriers carrying lugs aligned with the compression cuts, advancing the carriers towards one another with the lugs engaging in respective ones of the compression cuts while the closure panels are in generally upstanding positions, thereafter folding the closure panels to overlapped positions while the lugs move with the closure panels and tilt relative to the carriers to generally horizontal position and at the same time moving the carriers closer together with the lugs drawing the closure panels to thereby draw the side panels together to tightly engage containers positioned between the side panels.

15. A method according to claim 14 wherein the lugs carry projecting fingers which are directly engaged in the carton closure panel compression cuts while the lugs form stop means for limiting movement of the fingers into the cuts.

16. A method according to claim 14 together with the step of supporting the lugs in the generally horizontal position, and thereafter moving the carriers apart and thereby disengaging the so supported lugs from the package.

17. A method according to claim 14 wherein said compression cuts are formed in transversely intermediate portions of said closure panels.

18. A variable plane compression apparatus for automatically drawing side panels of cartons of the wrap around type tightly together in the formation of a package, said apparatus comprising a pair of generally opposed carriers, tightening lugs carried by said carriers in opposed relation, and mounting means pivotally mounting said lugs on said carriers for tilting movement between downwardly sloping positions and generally horizontal positions whereby said lugs may engage carton closure panels, each lug carrying a projecting finger forming means for engagement in a compression cut in a carton closure panel with each lug forming stop means for limiting movement of each finger into such cut.

19. An apparatus according to claim 18 wherein said lugs have longitudinal positions relative to a package being formed independently of the position of containers in that package.

20. An apparatus according the claim 1 wherein said carriers lie in a horizontal plane.

* * * * *